United States Patent [19]

Guenard et al.

[11] Patent Number: 4,562,961

[45] Date of Patent: Jan. 7, 1986

[54] NOZZLE END-PIECE FOR HOT GUNITING

[75] Inventors: Claude Guenard; Hugues Zanetta, both of Metz; Jean-Claude Grosjean, Semecourt, all of France

[73] Assignee: IRSID Institut de Recherches de la Siderurgie Francaise, St.-Germain-En-Laye, France

[21] Appl. No.: 531,914

[22] Filed: Sep. 12, 1983

[30] Foreign Application Priority Data

Sep. 13, 1982 [FR] France ..... 82 15461

[51] Int. Cl.[4] ..... B05B 1/24

[52] U.S. Cl. ..... 239/79; 239/450; 239/536

[58] Field of Search ..... 239/79, 80, 85, 423, 239/424, 424.5, 425, 450, 536, 419.3

[56] References Cited

U.S. PATENT DOCUMENTS

| | | | |
|---|---|---|---|
| 1,721,381 | 7/1929 | Ellis | 239/425 |
| 1,758,473 | 5/1930 | Schoop | 239/85 X |
| 3,118,758 | 1/1964 | Ross | 239/424.5 X |
| 3,814,327 | 6/1974 | Dada | 239/424 X |

FOREIGN PATENT DOCUMENTS 2419484 12/1978 France .

*Primary Examiner*—Andres Kashnikow
*Assistant Examiner*—Daniel R. Edelbrock
*Attorney, Agent, or Firm*—Karl F. Ross; Herbert Dubno

[57] ABSTRACT

This guniting nozzle end piece for projecting a refractory powder through a flame, the nozzle being connected to a combustive gas, fuel gas and refractory powder feed, one of the gases being the gas carrying the powder in the end-piece, is characterized in that, generally cylindrical in shape, it comprises a plurality of individual tubes (9) disposed in at least one ring (9a,9b) of tubes coaxial with the end-piece (1), opening on the one side at the level of the nose (11) of the end-piece and connected on the other side to the refractory powder and carrier gas feed (20), the plurality of tubes (9) being disposed between two coaxial substantially cylindrical walls respectively internal (12) and external (13), the gaps (24) between the tubes and between the tubes and the cylindrical walls forming a passage space opening on the one side at the level of the nose (11) of the end-piece and further connected to the non carrier gas feed (18).

5 Claims, 2 Drawing Figures

NOZZLE END-PIECE FOR HOT GUNITING

FIELD OF THE INVENTION

The invention relates to a guniting nozzle end-piece for projecting a refractory powder through a flame, the nozzle being connected to a combustion-sustaining gas, fuel gas and refractory powder feed, one of the gases being the gas carrying the powder in the end-piece.

BACKGROUND OF THE INVENTION

A guniting nozzle of this type is known more especially from the document FR No. 2 419 484. More generally, guniting techniques have been the subject of numerous studies and patents: reference may for example be made to documents FR No. 2 168 916 and FR No. 2 066 355.

It is known that one of the major problems related to these techniques is that of obtaining a maximum rise of the temperature of the refractory powder before this latter reaches the wall to be repaired, so as to obtain the formation of a dense and homogeneous layer of product. If a sufficiently high temperature is not obtainable, products have to be used which are not very refractory and which are not suitable for all applications.

Pre-heating of the surface to be repaired does not provide an efficient solution to the problem.

The incorporation in the refractory powder of a fuel element such as carbon has not proved to be very favorable because of the increase of the porosity of the product projected due to the incomplete combustion of the carbon. Mixing with the powder a metal adapted to burn in oxygen with release of heat leads to a costly technique (for example in the case of magnesium), which is sometimes incompatible with the material to be deposited (for example, aluminum incompatible with MgO), which can be undesirable (for example, in the case of iron which lowers the refractoriness), and finally which can be dangerous (because of the risks of combustion of the metal in the transporting oxygen).

The nozzle described in document FR No. 2 419 484 in which the oxygen from a central duct is mixed, at the outlet of the nozzle, with natural gas conveying the refractory powder through an annular duct has the advantage of simplicity. However, the efficiency of the nozzle remains low (high power for a low powder temperature).

OBJECT OF THE INVENTION

The object of the invention is to provide a guniting nozzle which, while being of the greatest simplicity on the technical level, nevertheless allows the powder to reach high temperatures, without however the disadvantages of the above-mentioned teachings.

SUMMARY OF THE INVENTION

This object is achieved in accordance with the invention a guniting nozzle end piece generally cylindrical in shape which comprises a plurality of individual tubes disposed in at least one ring of tubes coaxial with the end-piece, opening at the level of the nose of the end-piece (lie flush therewith) and connected to a refractory powder and carrier gas feed, said plurality of tubes being disposed between two coaxial substantially cylindrical walls, namely an internal wall and an external wall, the gaps between the tubes and between the tubes and the cylindrical walls forming a passage space opening on one side at the level of the nose of the end-piece and further connected to a non-carrier gas feed.

In fact, it has been discovered, in accordance with the invention, that the fractionation of the powder and of the flame gives a hotter better distributed flame, i.e. leading to a good temperature homogeneity beyond the flame tips. The powder particles are also more homogeneous from the pressure and speed point of view. Since a long flame is obtained, the contact time of the particles and the flame is sufficient to ensure a high temperature of the powder. The product rejected is homogeneous and of low porosity. The efficiency is high.

Because of the extreme simplicity of construction it may be very readily adapted to the need; thus, to increase the power, it is sufficient to add one or more rings of tubes.

Furthermore, the invention allows an entirely pneumatic distribution system to be used, better adapted than the mechanical distributing systems.

Advantageously, the tubes of the same ring are disposed contiguously, at least a plane of the nose of the end-piece.

Advantageously, the rings of tubes are disposed substantially contiguously with respect to each other and with respect to the cylindrical walls, at least at the plane of the nose of the end-piece, the ratio of the outlet cross sections thus obtained for the different ducts (tubes on the one hand, and gaps on the other) allowing a good combination of the flowrates and pressures.

Advantageously, the internal cylindrical wall is provided with a front closure at the level of the nose of the end-piece, whereas it comprises orifices communicating the interstitial passage space with the hollow inner volume of said wall, this volume being itself connected to the non-carrier gas feed.

According to one embodiment of the invention, the end-piece comprises at least thirty tubes.

BRIEF DESCRIPTION OF THE DRAWING

Other advantages and features of the invention will be clear from the following description of a preferred embodiment, with reference to the accompanying drawing in which.

SPECIFIC DESCRIPTION

Figure 1:
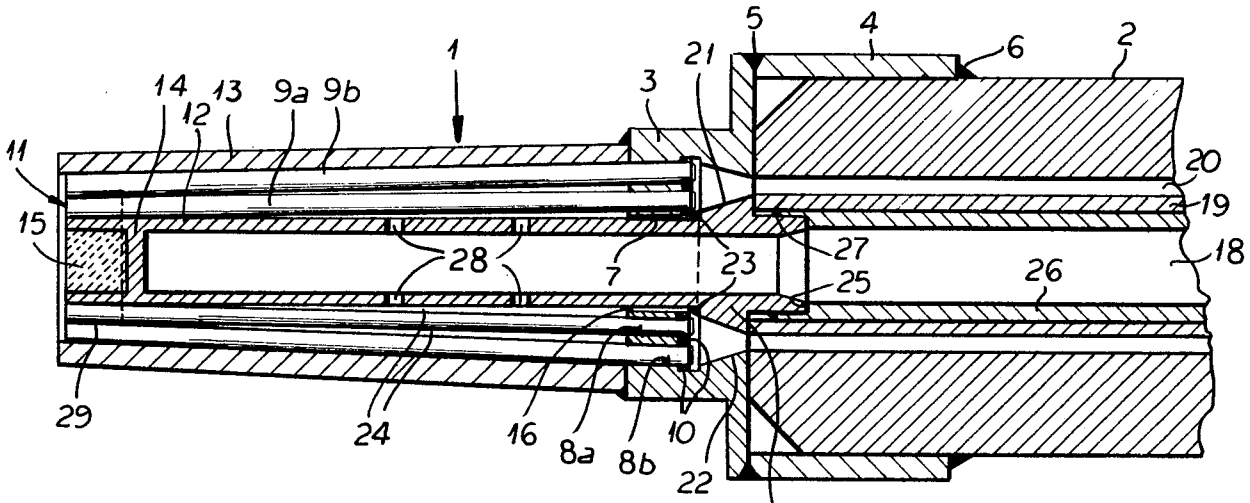
FIG. 1 shows in longitudinal section an end-piece in accordance with the invention adapted to form the end of a guniting nozzle.
Figure 2:
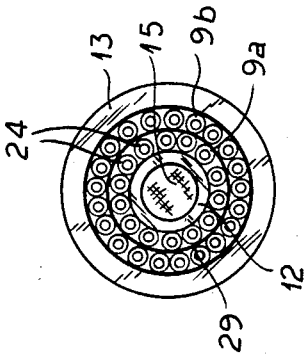
FIG. 2 is an end view of the nose of the end-piece of FIG. 1.

The end-piece 1 fitted to the guniting nozzle 2, comprises a tube-holding barrel 3 held on the front end of nozzle 2 by means of a stainless steel holding ring 4 brazed at 5 and 6 to the barrel 3 and to the cylindrical contour of the nozzle 2.

The stainless steel barrel 3 comprises a central bore 7 of relatively large diameter and two rings of bores **8*a* and 8*b* in which 35 copper tubes are inserted, distributed over two rings of tubes 9*a* and 9*b*, 150 mm long and 3.8 mm inner diameter, fixed at one of their ends by brazing 10**.

Tubes **9*a* and 9*b* form at their other ends the nose 11 of end-piece 1: they are contiguous with each other at this level, i.e. their mouths are coplanar, and are gripped between the ends of two substantially cylindrical walls, respectively internal wall 12 and external wall 13**.

The external wall 13 made from copper surrounds the ring of tubes **9*b* and is brazed to the barrel 3. Although it may be qualified as substantially cylindrical, in the embodiment shown it has in fact a slight conical shape of the order of 3%, adapted to the convergence of tubes 9. Wall 13 may project slightly beyond the plane of the nose 11 of end-piece 1**.

The internal wall 12 has the shape of a generally hollow cylinder, flush with the nose 11 of end-piece 1, closed on this side by a front wall 14 forming a cavity receiving an insulating refractory 15.

The cylindrical wall 12 passes through the central bore 7 of barrel 3 in which it is centered by centering ribs 16. It comprises a shoulder 17 in the neighborhood of the nose of nozzle 2.

The nozzle 2 comprises a central duct 18 connected to a feed for a gas not carrying the refractory powder, for example the combustion-supporting gas (here oxygen). The central duct 18 is separated by an annular wall 19 from an annular duct 20 connected to a refractory powder and carrier gas, e.g. the fuel gas, feed.

Shoulder 17 has a conical contour 21 which forms with a contour 22, also conical, of barrel 3 an annular passage conducting the refractory powder conveyed by its carrier gas from the outlet of the annular duct 20 to the inlets of tubes 9. A copper seal 23 provides sealing between the annular passage and the interstitial space between tubes 9 and walls 12 and 13.

The cylindrical wall 12 is extended inwardly of the duct 18 of nozzle 2 and bears on a bearing surface 25 of a mating tube 26 to which it is brazed at 27.

Eight orifices 28 allow the oxygen arriving through the central duct 18 to pass into the interstitial passage space 24, from which it emerges at the level of the nose 11 of the end-piece.

A thin brass ring 29 (for example ½ mm thick) may be placed between the two rings of tubes 9*a* and 9*b* over a short length (15 mm for example).

The operation of the device is clear: by injecting into the nozzle, on the one hand the oxygen gas and, on the other, the refratory powder carried by the fuel gas, the powder and the flame are fractionated, which provides maximum heating of the powder, without bringing the temperature of the wall into play.

The end-piece of the invention is then particularly well adapted to projecting products of high refractoriness whose use is required in steel-making.

We claim:

1. An end piece for a guniting nozzle adapted to project a refractory powder through a flame, said nozzle having a passage for a combustion-sustaining gas, and a passage for a fuel gas entraining the refractory powder, said end piece comprising:

an axially extending cylindrical inner pipe communicating at one end with said passage for said combustion-sustaining gas and provided with means forming a closure at an opposite end of said inner pipe;

at least one circular array of tubes extending the length of said inner pipe and surrounding same, said array being coaxial with said inner pipe and the tubes of said array communicating with said passage for the fuel gas and refractory powder, said tubes being open and lying in a common plane at respective ends of said tubes substantially flush with said opposite end of said inner pipe; and an outer pipe coaxially surrounding said inner pipe and defining with said inner pipe interstices between said tubes opening at said plane, said inner pipe being provided along its length with a plurality of through-going bores connecting the interior of said inner pipe with said interstices whereby said fuel gas and refractory powder emerge from said tubes at said plane while said combustion-sustaining gas is delivered to said interstices and emerges from between said tubes at said plane.

2. The end piece defined in claim 1 wherein said end piece is connected to said nozzle and said nozzle has a central passage surrounded by an annular duct, said annular duct being the passage for said fuel gas and said refractory particles and said central passage being the passage for said combustion-sustaining gas.

3. The end piece defined in claim 1 wherein said tubes are composed of copper.

4. The end piece defined in claim 1 wherein at least 30 such tubes are provided between said pipes in at least two annular arrays to define said interstices.

5. The end piece defined in claim 1 wherein the combustion-sustaining gas is oxygen.

* * * * *